United States Patent [19]
Seldeen
[11] 4,298,150
[45] Nov. 3, 1981

[54] PISTOL CHARGING HOLSTER

[76] Inventor: Richard Seldeen, 222 Ramona Pl., Camarillo, Calif. 93010

[21] Appl. No.: 180,041

[22] Filed: Aug. 21, 1980

[51] Int. Cl.³ ..... F41C 33/02
[52] U.S. Cl. ..... 224/243; 224/911; 224/912; 224/238
[58] Field of Search ..... 224/243, 193, 198, 238, 224/911, 912

[56] References Cited

U.S. PATENT DOCUMENTS 3,763,587 10/1973 Firmalino ..... 224/912 X
3,804,306 4/1974 Azurin ..... 224/193

*Primary Examiner*—Steven M. Pollard
*Attorney, Agent, or Firm*—Jack C. Munro

[57] ABSTRACT

A holster which is adapted to be used with a particular type of pistol wherein the pistol has a slide which is movable with respect to the barrel and movement of the slide causes charging of the pistol. The holster includes a sheath which is adapted to be located closely about the free end of the slide of the pistol. The sheath includes a stop in the form of a protuberance which is to engage with the slide and prevent relative movement in one direction of the slide. Movement in this one direction causes the barrel to protrude from the slide resulting in the necessary motion to cause charging of the pistol.

7 Claims, 6 Drawing Figures

PISTOL CHARGING HOLSTER

BACKGROUND OF THE INVENTION

The field of this invention relates to firearms and more particularly to a holster which is to facilitate cocking of a pistol.

At the present time there are principally two different types of pistols which are available. One type of pistol employes a rotating cylinder and the rounds of ammunition are held within several firing chambers formed within the cylinders. This type of pistol includes a double action device, which means as the trigger is pulled, the cylinder is rotated to place a round in the proper position for firing. Each time the trigger is pulled, a round is again located in the proper position for firing.

The second type of pistol includes only one firing chamber. The rounds of ammunition are supplied to the firing chamber by means of a clip which is mounted within the handle of the pistol. Ejecting of the expended round and reinserting of a "live" round into the firing chamber is accomplished through the use of a slide which is movable in respect to a barrel of the pistol. This slide is movable between a forward position and an aft position and when in the aft position the barrel extends forwardly of the slide. In this position, the firing chamber is exposed to the ambient.

One type of slide pistol is what is frequently termed a Colt 45, Government Model, Automatic Caliber Pistol. A disadvantage to this type of pistol is that it does not include a trigger actuated double action device. The firing of the round results in the slide being moved rearwardly to effect cocking of the pistol and the supplying of the new "live" round into the firing chamber.

In certan fields, such as law enforcement, it is more desirable to use this slide type of pistol rather than a cylinder type of pistol. The primary advantage is that the slide type of pistol is more powerful and that a law enforcement officer firing at an adversary, and then hits the adversary practically anywhere, will knock that person to the ground. With the cylinder type of pistol, which is generally of a smaller caliber, this is frequently not the case, and actually the adversary could be hit two or maybe three times and still keep on his feet. Obviously, the quicker the individual is knocked off his feet, the less the chance that he is able to return fire, therefore causing injury or possible death to the law enforcement officer.

However, in the past, in order for a law enforcement officer to carry the slide type of pistol and have that pistol "ready for action", the law enforcement officer must carry a "live" round in the chamber and the hammer of the pistol in the cocked position. This is dangerous because it greatly enhances the possibility of accidental discharge of the pistol, which usually occurs when the law enforcement officer is attempting to draw the pistol quickly. Drawing the pistol quickly at certain times, can make the difference between life and death. This accidental discharge can very easily result in the law enforcement officer shooting himself in the leg or foot.

Therefore, any law enforcement officer who carries the slide type of pistol, in order to avoid the possibility of accidental discharge, does either one of two things. The first is to carry a "live" round of ammunition in the chamber. The second is to not have a "live" round in the firing chamber and keep the hammer in the uncocked position. The first situation requires that the operator of the pistol physically move the hammer to the cocked position prior to firing. The second situation requires the operator of the pistol to manually move the slide in respect to the barrel to the fully retracted position so as to locate a "live" round within the firing chamber and also to cock the hammer. Each instance is time consuming and in situations when tenths of a second can make the difference between life and death, the law enforcement officer, or other operator, has found himself to be at an extreme disadvantage.

It would be desirable to design some type of holster for the slide type of pistol in which the holster facilitated quick cocking and the inserting of a "live" round within the firing chamber of the pistol, so that the law enforcement officer, or other operator, can have almost the equivalent fast-draw capability of the normal cylinder type of pistol.

SUMMARY OF THE INVENTION

The structure of this invention relates to a holster which is to facilitate carrying of a pistol and also to expedite the cocking of the hammer of the pistol and the locating of a "live" round within the firing chamber of the pistol. The holster of this invention is designed to be employed with a particular type of pistol wherein the pistol has a slide which is movable about the barrel. Movement of the slide between the forward position to the retracted position results in the cocking of the hammer and the locating of the live round within the firing chamber. The holster of this invention includes a sheath which surrounds the slide in a closely conforming manner. The outer end of the sheath is open. Within the sheath is located a strip of material, which is to abut the outer edge of the slide, but not interfere with the barrel. The pistol is to be carried within the holster in an uncocked position and with no "live" round within the firing chamber. If the operator desires to quickly draw the pistol, it is only necessary for the operator to manually push down on the pistol which results in the slide being fixed in position in respect to the holster due to the slide being in contact with the U-shaped strap. In the downward motion, the barrel is moved to the extended position in respect to the slide, which is the normal movement to effect placing of a live round within the firing chamber and cocking of the hammer. The pistol is then withdrawn from the holster, at which time the slide automatically moves back to its extended position about the barrel and the pistol is ready for immediate firing.

The primary objective of this invention is to construct a holster which is to be usable with this slide type of pistol in order to facilitate fast draw of that pistol.

Another objective of the holster of this invention is that the slide type of pistol may be transported safely in an uncocked status with no round within the firing chamber and yet the operator can quickly effect drawing of that pistol and have it ready for firing.

Another objective of this invention is to construct a holster which is made of relatively few parts and can be manufactured inexpensively.

DETAILED DESCRIPTION OF THE SHOWN EMBODIMENT

Figure 1:
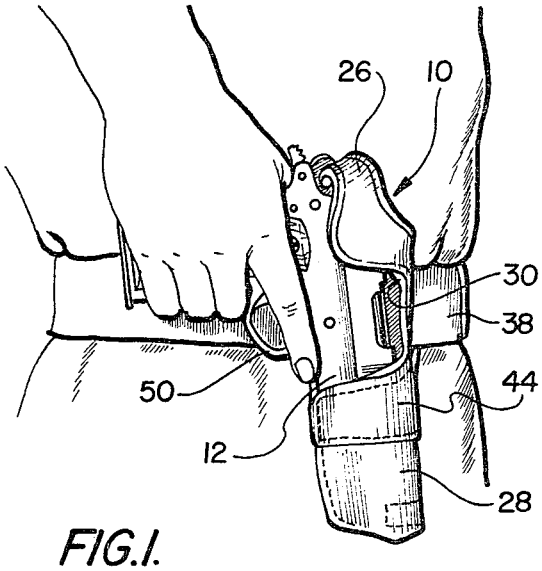
FIG. 1 is an elevational view showing the holster of this invention being mounted by a belt about the waist area of the operator with the pistol being located within the holster.
Figure 2:
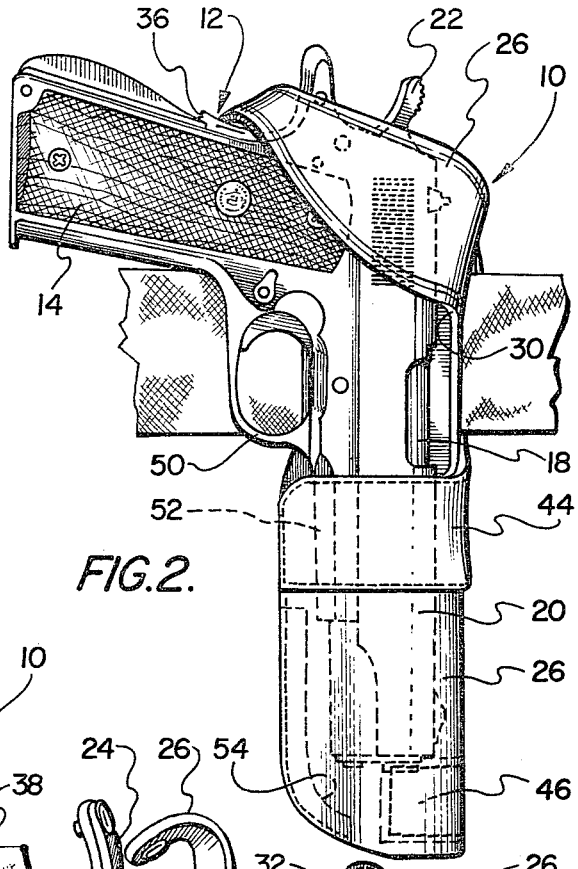
FIG. 2 is a view similar to FIG. 1 but showing the holster in phantom to show the pistol in its normally carried position in respect to the holster.
Figure 3:
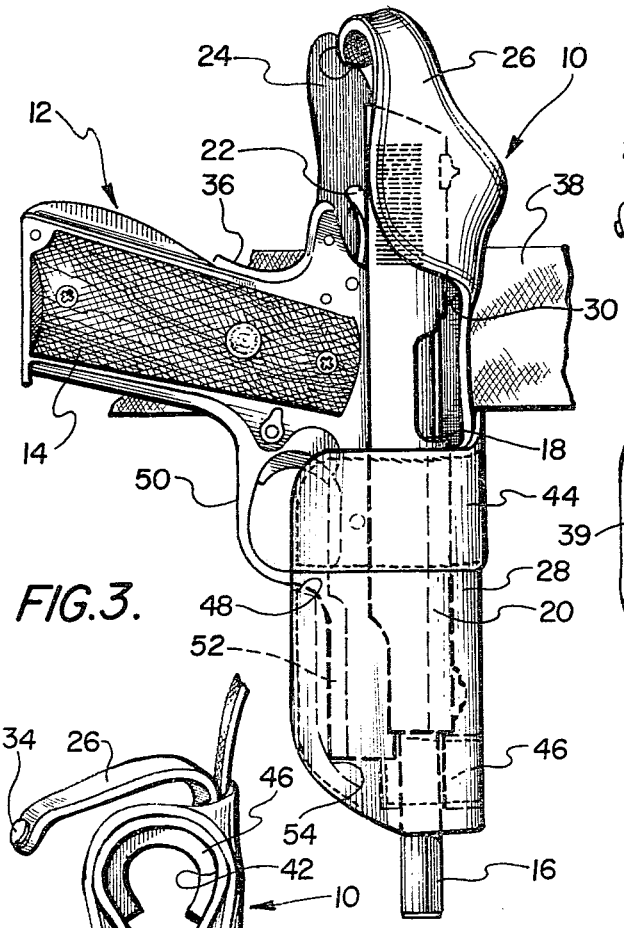
FIG. 3 is a view similar to FIG. 2, but showing the pistol in the charged position.
Figure 4:
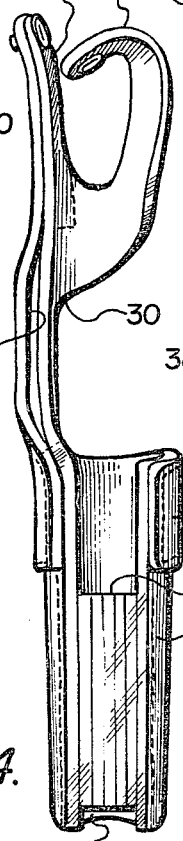
FIG. 4 is a back, elevational view of the holster of this invention.
Figure 5:
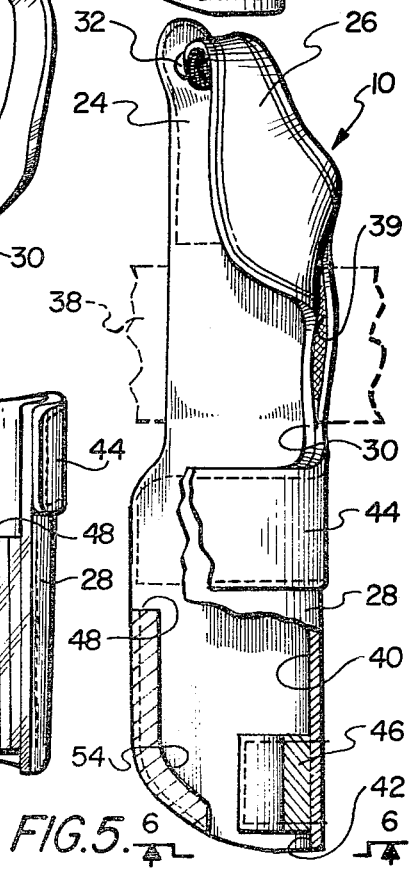
FIG. 5 is a partially cut-away, side, elevational view of the holster of this invention.
Figure 6:
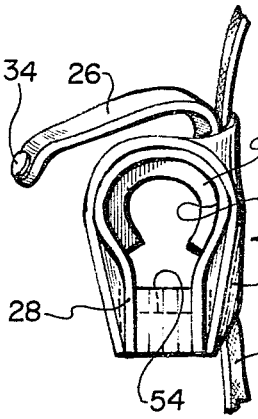
FIG. 6 is an end view of the holster of this invention taken along line 5—5 of FIG. 4.

Referring particularly to the drawing, there is shown the holster 10 of this invention which is to connect with pistol 12. Pistol 12 includes a handle section 14, a barrel 16 which connects with the firing chamber 18 and a slide 20. Lineal movement of the slide 20 from the forward, or extended position, as is shown within FIG. 2, to the retracted, or aft position, shown in FIG. 3, results in the firing hammer 22 being moved from the uncocked position to the cocked position and a "live" round of ammunition being inserted within the firing chamber 18. In this position, it is to be noted that the barrel 16 is extended with respect to the slide 20, as is shown within FIG. 3.

The holster 10 has at one end thereof, a pair of straps 24 and 26, and at the opposite end thereof, a sheath 28. Separating the strap 26 and the sheath 28 is a recessed area 30. The recessed area 30 is for the purpose of allowing the pistol 12 to eject any cartridge present within the firing chamber 18 during the charging process. It is to be understood that the charging process is to be defined as not only cocking of the hammer, but also to the inserting of a "live" round of ammunation within the firing chamber 18. A cartridge would not normally be present within the firing chamber during normal carrying of the pistol. However, if a cartridge was located within the firing chamber 18 when the charging process was initiated, the cartridge could not be ejected without the recess 30, which would probably cause the pistol to jam.

It is to be understood that the primary material of construction for the holster 10 would be a material, such as leather or plastic. However, any similar type of material could be employed.

The straps 24 and 26 are to be locatable about the handle 14 of the pistol to lock the pistol 12 within the holster 10. Strap 24 includes a female fastener 32 which is to releasably engage with the male fastener 34 on the strap 26. On the backside of the handle 14, is a depressable safety lever 36 which must be depressed before the pistol 12 can be fired. Straps 24 and 26 are connected together to tightly hold the pistol 12 within the holster 10, but not so tightly as to depress safety 36 which would tend to encourage accidental discharge of the pistol 12.

The holster 10 is to be attached to the wearer in the waist area by means of a conventional belt 38. The belt 38 passes through an appropriate opening 39 formed on the backside of the holster 10.

The sheath 28 includes an encasing chamber 40 which is to closely conform around the outer end of the slide 20. The encasing chamber 40 has an inlet opening directly adjacent the recess 30 to permit entry of the slide 20 to within the encasing chamber 40. The outer end of the encasing chamber 40 connects with an outlet opening 42.

Normally, it is required for the sheath 28 to have a certain amount of rigidity. For this purpose, there will generally be included a stiffening layer 42. This stiffening layer 44 will normally be leather with a metallic band (not shown) located between the leather outer layer of the stiffening layer 44 and the sheath 28.

Sewn, or otherwise fastened to the sheath 28 adjacent the opening 42 within the encasing chamber 40, is a stop in the form of a U-shaped strip of material (such as leather) 46. This strip of material 46 is to rest at all times against the forward edge of the slide 20 when the pistol 12 is located within the holster 10.

Also formed within the sheath 28, in the area adjacent the stiffening layer 44, is a slot 48. The function of the slot 48 is to permit entry of the trigger guard 50 of the pistol 12 during the charging procedure.

In order to achieve the charging of the pistol 12, the wearer grasps the handle 14 and merely exerts a downward motion of sufficient force. This results in the barrel 16 extending and moving past the strap 46 extending exteriorly of the outlet opening 42. Movement in the downward direction is continued until the frame 52 of the pistol 12 comes into contact with ledge 54 of the holster 10. This ledge 54 limits the amount of downward movement, since excessive downward movement will cause the slide 20 to become locked with respect to the frame 52. It is to be noted that the barrel 16 is attached to the frame 52. However, the downward movement is sufficient until a "live" round of ammunition is inserted within the firing chamber 18 and the hammer 22 is located in the cocked position.

During this charging procedure, movement of the slide 20 is prevented since it abuts strap 46. The locating of the position of the ledge 54 and the end of the strap 26 is precise so as to achieve the desired charging procedure.

After the pistol 12 has been fully charged, the wearer is to then remove the pistol 12 in an upward position from the holster 20. As the pistol 12 is drawn, the slide 20 moves again to the extended position. The pistol is now in the ready-to-use position.

What is claimed is:

1. In combination with a pistol which has a barrel through which a round is to pass from the firing chamber, said pistol having a trigger assembly, said pistol having a slide located about said barrel, said slide having an outermost end, said slide to be movable in respect to said barrel between a first position and a second position, with said slide in said first position the said barrel is confined within said slide, with said slide in said second position the said barrel is extended outwardly from said outermost end of said slide, movement of said slide from said first position to said second position causes charging of said pistol and upon return of said slide to said first position a round is to be located within said firing chamber, the improvement comprising a holster to facilitate charging of said pistol:

a holster housing having a fore end and an aft end, said fore end being formed into a sheath having a fixed sidewall forming an open ended encasing chamber, said encasing chamber having an inlet opening and an outlet opening, said outlet opening connecting with a recessed area open to the ambient, said firing chamber located within said recessed area, said slide to extend through said inlet opening and be located within said encasing chamber with said sheath located in a close fitting arrangement about said slide; and means included within said encasing chamber, said means being attached to said sheath, said means to engage with said outermost end of said slide and fixedly position said slide in respect to said sheath during movement of said barrel to be outwardly extended in respect to said outermost end of said slide, said means comprising a protuberance protruding into said encasing chamber, said protuberance being located directly adjacent said outlet opening.

2. The combination as defined in claim 1 wherein:

said protuberance comprising a U-shaped strap.

3. The combination as defined in claim 1 wherein:

said sheath includes limit means, said limit means to limit the extent of the charging movement of said barrel in respect to said slide, said limit means being attached to said sheath and located within said encasing chamber.

4. The combination as defined in claim 3 wherein:

said limit means comprising a ledge restricting the cross-sectional area of said encasing chamber.

5. The combination as defined in claim 4 wherein:

said sheath having a slot, said trigger assembly to move within said slot during charging of said pistol.

6. The combination as defined in claim 5 wherein:

said protuberance comprising a U-shaped strap.

7. The combination as defined in claim 1 wherein:

said sheath having a slot, said trigger assembly to move within said slot during charging of said pistol.

* * * * *